United States Patent [19]

Ware

[11] 4,298,917

[45] Nov. 3, 1981

[54] MOTION LIGHT DEVICE

[76] Inventor: Donna L. Ware, 8001 SW. Fifth St., North Lauderdale, Fla. 33068

[21] Appl. No.: 90,427

[22] Filed: Nov. 1, 1979

[51] Int. Cl.[3] ..... F21L 7/00

[52] U.S. Cl. ..... 362/157; 362/103; 362/184; 362/251; 362/252; 362/800

[58] Field of Search ..... 362/157, 184, 251, 252, 362/800, 103

[56] References Cited

U.S. PATENT DOCUMENTS 2,572,760 10/1951 Rikelman ..... 362/103

*Primary Examiner*—Stephen J. Lechert, Jr.
*Attorney, Agent, or Firm*—Malin & Haley

[57] ABSTRACT

A plurality of lighting devices connected to a power source and a switching lighting circuit connected between the light devices and the battery source. The switching lighting circuit includes a chain switching device which is responsive to motion, such that when the motion light device is attached to any moving object, the making and breaking of the links of the chain switching device will cause the flashing of the lighting device.

6 Claims, 3 Drawing Figures

MOTION LIGHT DEVICE

BACKGROUND OF THE INVENTION

The present invention relates generally to battery powered flashing motion light device and more particularly to ornamental battery powered flashing motion light device which provides a flashing effect when attached to a moving object, the flashing effect being caused by the making and breaking of the adjacently interconnected links which is connected between the light sources and the battery.

In the past, there have been various inventions where the illuminated devices have been attached to moving objects. However, none of the other prior inventions have illustrated a non-complex structure to provide the flashing operation of the illuminated devices. By way of example is U.S. Pat. No. 3,968,357, wherein an illuminated earring which is switched on by securement to the ear is illustrated. The novelty of this invention is the manner in which the battery is contacted with the conductor to turn the lighted earring into an on position. This is accomplished by having one leg of the U-shaped earring clip aligned with one of the terminals of the battery such that when the U-shaped leg contacts the terminal of the battery, an electrical circuit is completed providing power for illumination. The surface of the ornament is connected with light sources or light emitting devices in connections provided for energizing the sources. The present invention is unique in that it provides a means for giving a flashing effect to the light sources or light emitting devices without the use of sophisticated electrical circuitry. By electrically connecting a conductive chain switch between the lights and the battery source, a sporadic making and breaking of the interlocked links when the device is moved gives a flashing effect to the light sources.

SUMMARY OF THE INVENTION

The present invention provides a flashing motion lighting device which flashes relative to the movement of the object to which it is attached. A multiplicity of light sources or lighting devices are connected to a lighting circuit. The lighting circuit is attached to a battery source. The lighting circuit includes a conductive chain switch which is responsive to motion in order to make and break electrical contact between links. Once the device is attached to an object which has motion, the movement of the object causes the conductive links of the chain switch to intermittently lose contact with each other, thus giving a flashing effect to the light sources.

It is therefore an object of the present invention to provide a flashing lighting motion device with a chain switch which causes the light source to flash in response to movement of the object to which the device is attached.

It is a further object of the present invention to provide a sensible, decorative flashing light source which can be used to enhance one's dress or apparel.

It is yet another object of the present invention to provide a functional flashing light source which can be worn at night in unlighted areas for safety purposes.

In accordance with these and other objects which will now be apparent hereinafter, the instant invention will now be described with particular reference to the accompanying drawings.

DETAILED DESCRIPTION OF THE PREFERRED EMBODIMENT

Figure 1:
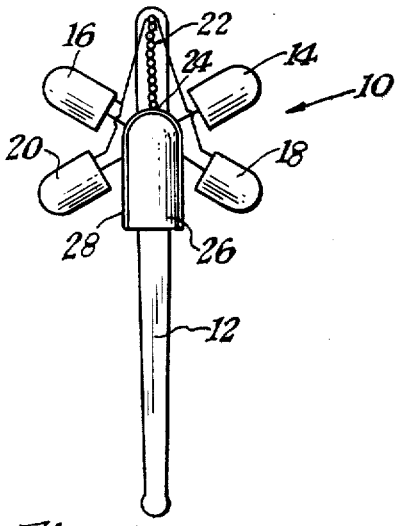
FIG. 1 represents a front view of the flashing motion light device.

Referring to FIG. 1, the flashing motion light device that is motion responsive is generally indicated by the reference numeral 10. The light source motion responsive device 10 comprises a spring clip 12 having the ground terminals of the light emitting diodes 14, 16, 18 and 20 electrically connected thereto. The positive terminals 30, 32, 34, and 36 of the light emitting diodes 14, 16, 18, and 20 are electrically connected to one end of a relatively long conductive chain switch 22. The other end of the conductive chain switch is electrically connected to the positive terminal 24 of the battery source 26. The negative case of the battery 24 is attached to the spring clip 12 which acts as a ground for the circuit. The battery 26 is held in place by a battery retainer clip 28, so that the battery 26 may be removed when the device is not in use.

Figure 2:
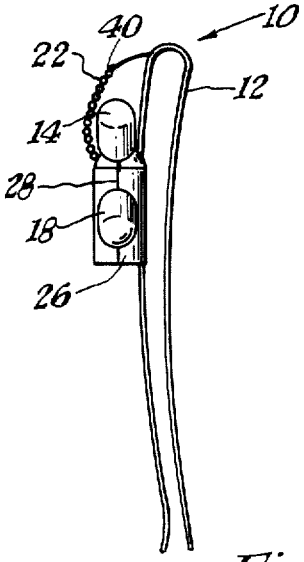
FIG. 2 represents a side view of the device shown in FIG. 1.

Referring to FIG. 2, the preferred shape of the spring clip 12 is illustrated, with the other components of the device being attached as described in the above paragraph. Various other types of clips or connecting means may be used.

Figure 3:
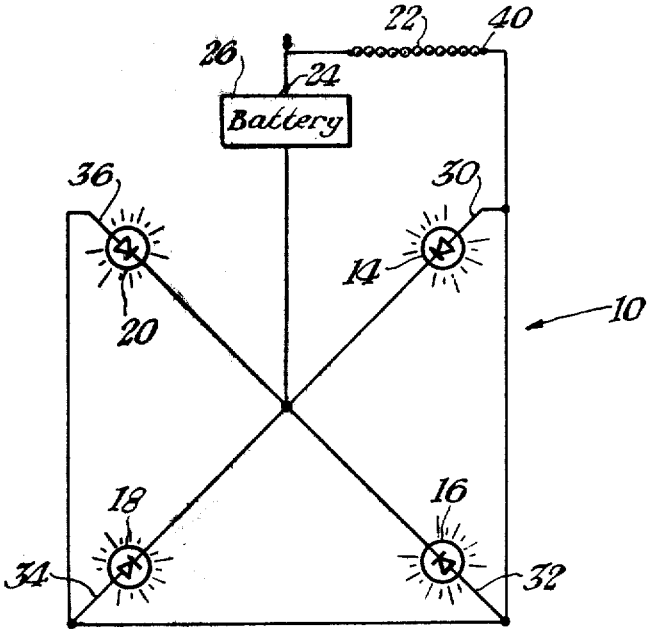
FIG. 3 represents a schematic diagram of the electrical circuit of the invention.

Referring to FIG. 3, a battery source 26 has its positive terminal connected to the positive terminals of light emitting diodes 14, 16, 18, and 20, through a conductive chain switch 22. The ground terminals of the light emitting diodes 14, 16, 18 and 20 are electrically connected to the ground terminal of the battery source 26.

Once the light source motion responsive device 10 is attached to any object which eventually moves, such as a dancer, the movement of the conductive chain switch 22 will cause the light sources 14, 16, 18 and 20 to flash on and off. The chain is somewhat longer than the distance between points 40 and 24.

Since the conductive links are in loose contact with one another when the chain is put in motion, the electrical circuit may be broken for a short time and no current flows, thus turning the light emitting diodes 14, 16, 18, and 20 to an off position. When the link again makes contact, the lights will turn on. Therefore, the lights will flash in response to the movement of the chain link switch 22 which is being moved in accordance with the object to which the light source motion responsive device 10 is attached.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A signaling system comprising:

at least one signaling means having a first terminal connectable to an electrical power source and a second terminal, said signaling means for providing an indication of movement in any direction, a switching means having a first end and second end, said second end connected to said second terminal, said first end connectable to an electrical power source, said switching means includes interconnected conductive links, said switching means for providing make and break electrical contact responsive to movement of said signaling system in any direction for providing electrical switching of said signaling means.

2. A signaling switch as set forth in claim 1 wherein, said switching means is a conductive chain.

3. A signaling system as set forth in claim 2 wherein, said signaling means is a light device for providing a visual indication.

4. A signaling system as set forth in claim 3 wherein, said light device is a light emitting diode.

5. A signaling system as set forth in claim 4 including; a portable battery, said first terminal and said first end connected to said portable battery.

6. A signaling system as set forth in claim 5 including, a connecting pin connected to said signaling means and to said first end of said chain to provide a novel flashing light pin when said signaling system is moved in any direction to cause movements of the interconnected links.

* * * * *